US005591303A

United States Patent [19]

Oulie et al.

[11] Patent Number: 5,591,303

[45] Date of Patent: Jan. 7, 1997

[54] PROCESS FOR OPERATING A DIGESTER

[75] Inventors: Finn Oulie; Ake Backlund; Johanna Svanberg, all of Karlstad, Sweden

[73] Assignee: Kvaerner Pulping Technologies AB, Karlstad, Sweden

[21] Appl. No.: 408,706

[22] Filed: Mar. 22, 1995

Related U.S. Application Data

[62] Division of Ser. No. 92,420, Jul. 16, 1993, Pat. No. 5,470,437.

[30] Foreign Application Priority Data

Nov. 18, 1992 [SE] Sweden ..... 9203462

[51] Int. Cl.[6] ..... D21C 3/26; D21C 7/12; D21C 7/14

[52] U.S. Cl. ..... 162/19; 162/17; 162/47; 162/60

[58] Field of Search ..... 162/237, 251, 162/249, 250, 246, 49, 60, 17, 19

[56] References Cited

U.S. PATENT DOCUMENTS

| | | | |
|---|---|---|---|
| 2,852,369 | 9/1958 | Elofson | 162/251 |
| 3,700,548 | 10/1972 | Rich | 162/17 |
| 3,811,994 | 5/1974 | Ostberg | 162/19 |
| 4,193,839 | 3/1980 | Sherman | 162/19 |
| 4,436,586 | 3/1984 | Elmore | 162/19 |
| 5,236,554 | 8/1993 | Greenwood | 162/238 |

FOREIGN PATENT DOCUMENTS

| | | |
|---|---|---|
| 0476230 | 3/1992 | European Pat. Off. . |
| 92578 | 10/1958 | Norway . |
| 130485 | 12/1974 | Norway . |
| 211196 | 7/1966 | Sweden . |

*Primary Examiner*—David L. Lacey
*Assistant Examiner*—Jose A. Fortuna
*Attorney, Agent, or Firm*—Cushman Darby & Cushman L.L.P.

[57] ABSTRACT

In a pulp digester for continuous cooking under raised pressure and temperature of fiber material in a vertical digester (1), input of fiber material and cooking liquid takes place at the top of the digester, withdrawal of spent cooking liquor is carried out from at least one digester screening arrangement (1D) between the top and the bottom of the digester, and fiber material is fed out from the bottom (1C) of the digester, and at least one screening arrangement (2) in the lower half of the digester, wherein at least one of said screening arrangements (1, 2) has at least one screen element (2A) of which the main configuration is of angular shape, preferably rectangular, most preferred square, having a screen face (3A) of which the total area is less than 1 $m^2$, and which is attached to the digester wall (1A) in a manner to form a sealed volume (V) from which liquid only can be supplied and withdrawn via said screen face (3A) and an inlet and outlet (15) respectively which outlet penetrates the digester wall (1A).

3 Claims, 11 Drawing Sheets

PROCESS FOR OPERATING A DIGESTER

This is a division of Application Ser. No. 08/092,420, filed Jul. 16, 1993 now U.S. Pat. No. 5,470,437.

FIELD OF THE INVENTION

This invention relates to a process and apparatus for treating cellulosic material such as wood chips for pulp making and, more specifically, for reducing or eliminating the use of environmentally undesireable chemicals in such a process.

BACKGROUND OF THE INVENTION

The environmental authorities are placing ever more stringent demands on the pulp industry to decrease the use of chemicals which can be damaging to the environment, such as, for example, chlorine. Thus, permitted discharges of organic chlorine compounds in the waste water from bleaching plants, following on from the cooking process, have been decreased progressively and are now at such a low level that pulp factories have in many cases stopped using organic chlorine compounds as bleaching agents. In addition, market forces are tending progressively to increase the demand for paper products which are not bleached with chlorine.

The pulp industry is therefore searching for methods which allow bleaching of pulp without using these chemicals. The lignox method (see SE-A 8902058), in which, inter alia, bleaching is carried out with hydrogen peroxide, may be mentioned as an example of such a method. Ozone is another interesting bleaching chemical which is also gaining increased application. It is thus possible, using bleaching chemicals of this nature, to achieve those brightnesses which are required for marketable pulp, i.e. 89 ISO and greater, without using chlorine-containing bleaching agents.

There is, however, a problem in using presently known bleaching procedures with these bleaching chemicals which do not contain chlorine, namely that they have a relatively large effect in diminishing the quality of the pulp fibres.

SUMMARY OF THE INVENTION

By means of experiments which have been conducted under the auspices of Kamyr AB, it has been found, surprisingly, that extremely good results, with regard to delignification and strength properties, can be obtained if the pulp is cooked at the same temperature level in substantially the whole of the digester, i.e., if essentially the same temperature is maintained in all cooking zones, and if a certain quantity of alkali is also supplied to the lowest zone in the digester, which zone is normally used for counter-current washing. Owing to the fact that essentially the same temperature level is maintained in virtually the whole of the digester, very extensive delignification can be achieved at a relatively lower temperature than used previously. In addition, it has been found that the strength properties are affected in a particularly favourable manner, that a higher yield of the crude fibre product is obtained and that the quantity of reject material decreases.

The invention relates to an advantageous arrangement of screens in the digester and feed conduits for achieving a cooking according to the new process, in particular with regard to digesters built according to an older principle and consisting of an upper concurrent cooking zone and a lower counter-current washing zone. Such an arrangement is necessary since certain practical problems arise as a consequence of an isothermal cooking process. The first such problem is the difficulty of efficiently reaching and maintaining the temperature in the lower part of the digester, i.e. that part which is normally employed for washing.

A principal object of this invention is to create a more efficient screening means in order to improve the circulation of the pulp and liquids and to improve the temperature distribution in the digester. The invention may be used in newly constructed digesters but also older digesters may be converted to use this invention.

These advantages are most clearly apparent from the diagrams shown in the FIG. 1 and 2, which show comparative values between pulp (softwood) which has been cooked using a conventional, modified cooking technique and pulp which has been cooked using the process according to the invention, (in a similar digester, i.e. with a concurrent upper cooking zone, a central counter-current cooking zone and a bottom counter-current washing zone) in which a constant temperature level of about +155° C. has been maintained in the whole digester.

The invention especially relates to a digester used with an isothermal process where certain practical problems arise as a consequence of the isothermal cooking process. The first such problem is the difficulty of efficiently reaching and maintaining the temperature in the lower part of the digester, i.e. that part which is normally employed for washing.

Furthermore it is an object of the invention to create an effective back flushing system in order to rinse the screen faces effectively. Especially the arrangement of pipings and valves in this context has as its object to be of an advantageous kind in terms of cost saving, installation facility, and the like.

DETAILED DESCRIPTION

Figure 1A:
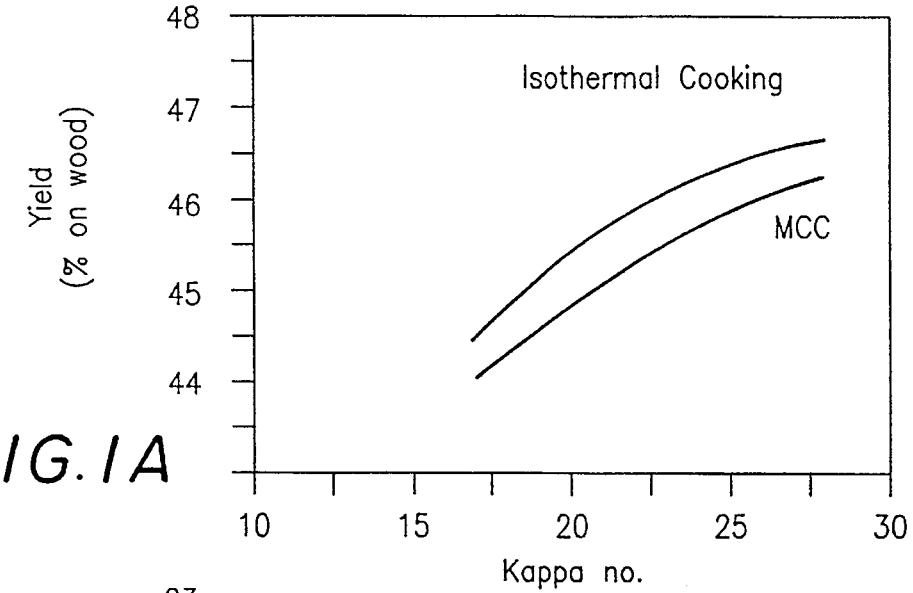
In FIG. 1A, 1B and 1C, a comparison is shown in three diagrams between isothermal cooking and so-called modified conventional cooking (MCC)
Figure 1B:
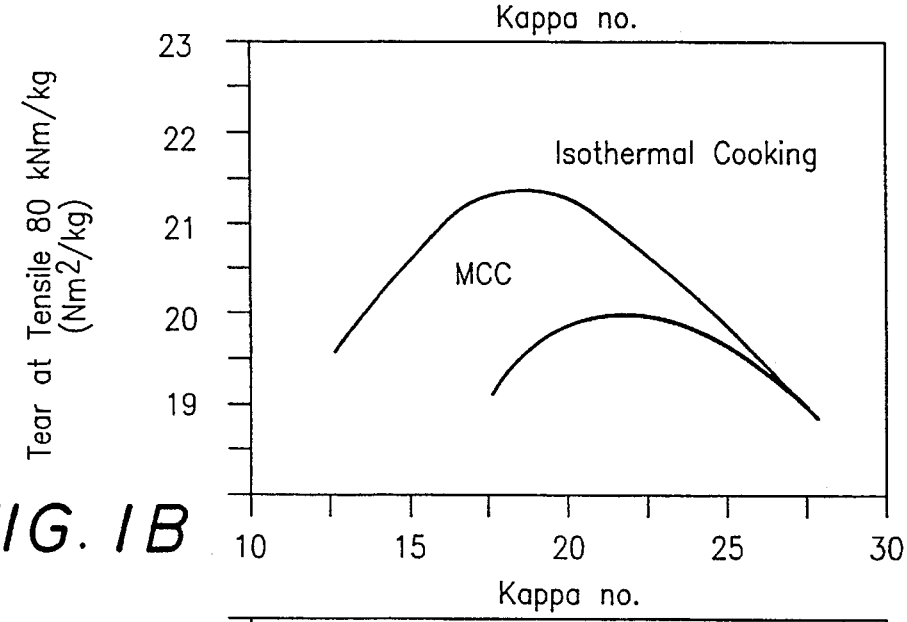
Figure 1C:
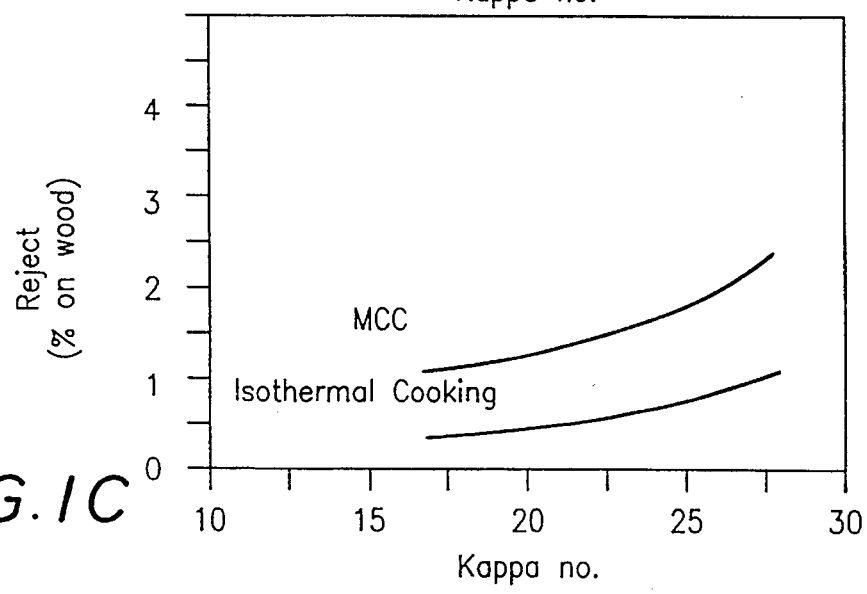

The advantages of the present invention are most clearly apparent from the diagrams shown in the FIG. 1A, 1B and 1C, which show comparative values between pulp (softwood) which has been cooked using a conventional, modified cooking technique and pulp which has been cooked using the process according to the invention, (in a similar digester, i.e. with a concurrent upper cooking zone, a central counter-current cooking zone and a bottom counter-current washing zone) in which a constant temperature level of about +155° C. has been maintained in the whole digester.

Figure 2:
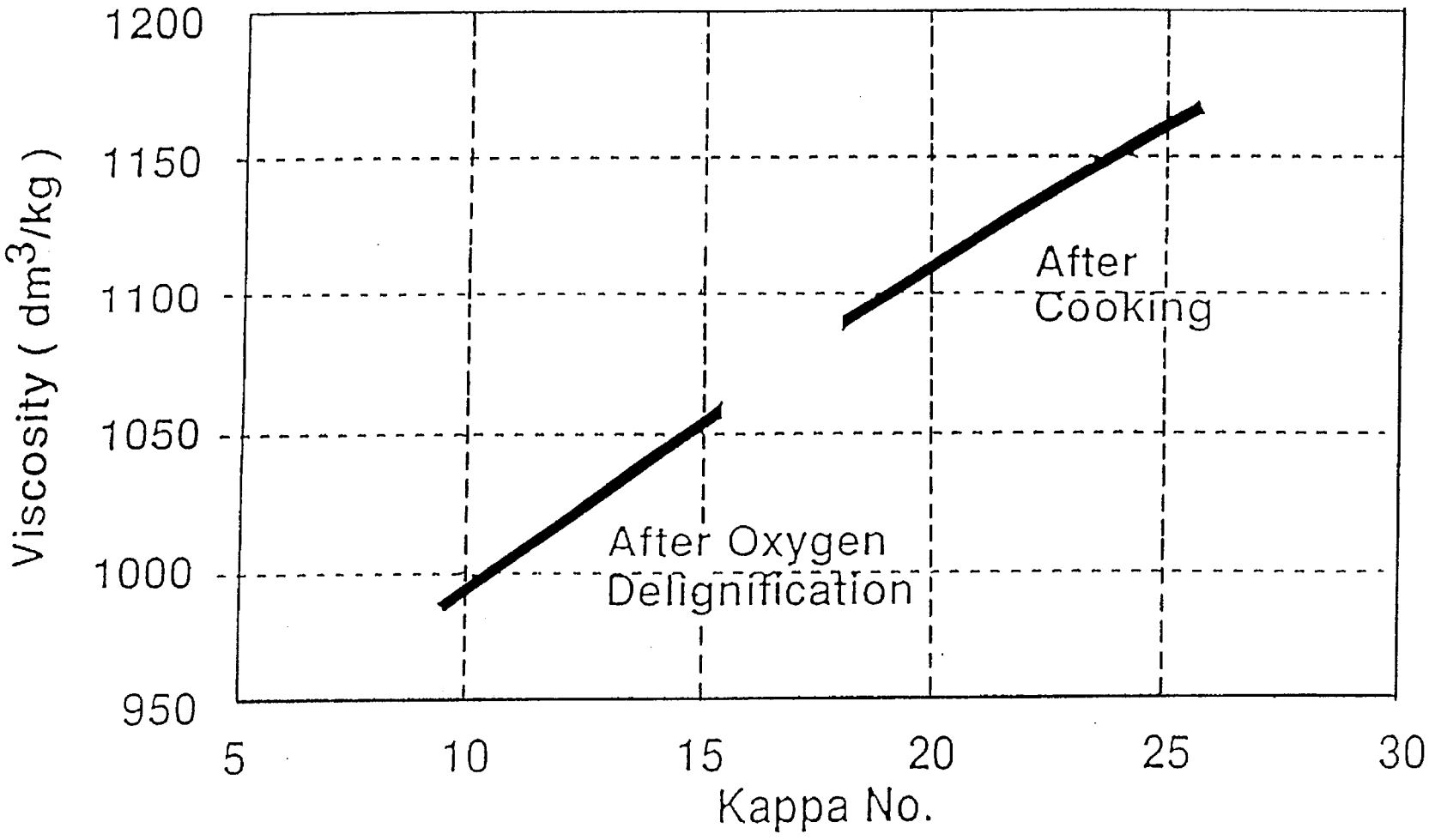
FIG. 2 shows a diagram which describes degree of delignification and viscosity (the viscosity is normally regarded as indicating the strength properties of the pulp)

The three diagrams of FIG. 1A, 1B and 1C compare different results obtained with isothermal cooking and modified conventional cooking (MCC). These surprisingly positive results show, according to FIG. 1A, that, with a given amount of added alkali, substantially lower kappa numbers are obtained using isothermal cooking. Furthermore, the second FIG. 1B shows that manifestly improved strength properties are obtained when cooking down to the same kappa number. In addition, the third FIG. 1C shows that there is also the advantage that the quantity of reject wood (shives) decreases. If the fact is also taken into account that overall substantial energy savings are made when the temperature level is kept constant as well as lower than previous temperatures, it is evident that the results may be regarded as being surprisingly positive. FIG. 2 additionally demonstrates that, using the method according to the invention, very low kappa numbers are reached while at the same time retaining good pulp strength (viscosity of about 1000) after oxygen delignification. Thus, when employing the method according to the invention, so-called environmentally friendly bleaching chemicals, such as peroxide and ozone, can be employed in subsequent bleaching stages without risking too low a strength for bleaching up to the level of brightness, and therewith also the level of purity, which the market demands.

Figure 3A:
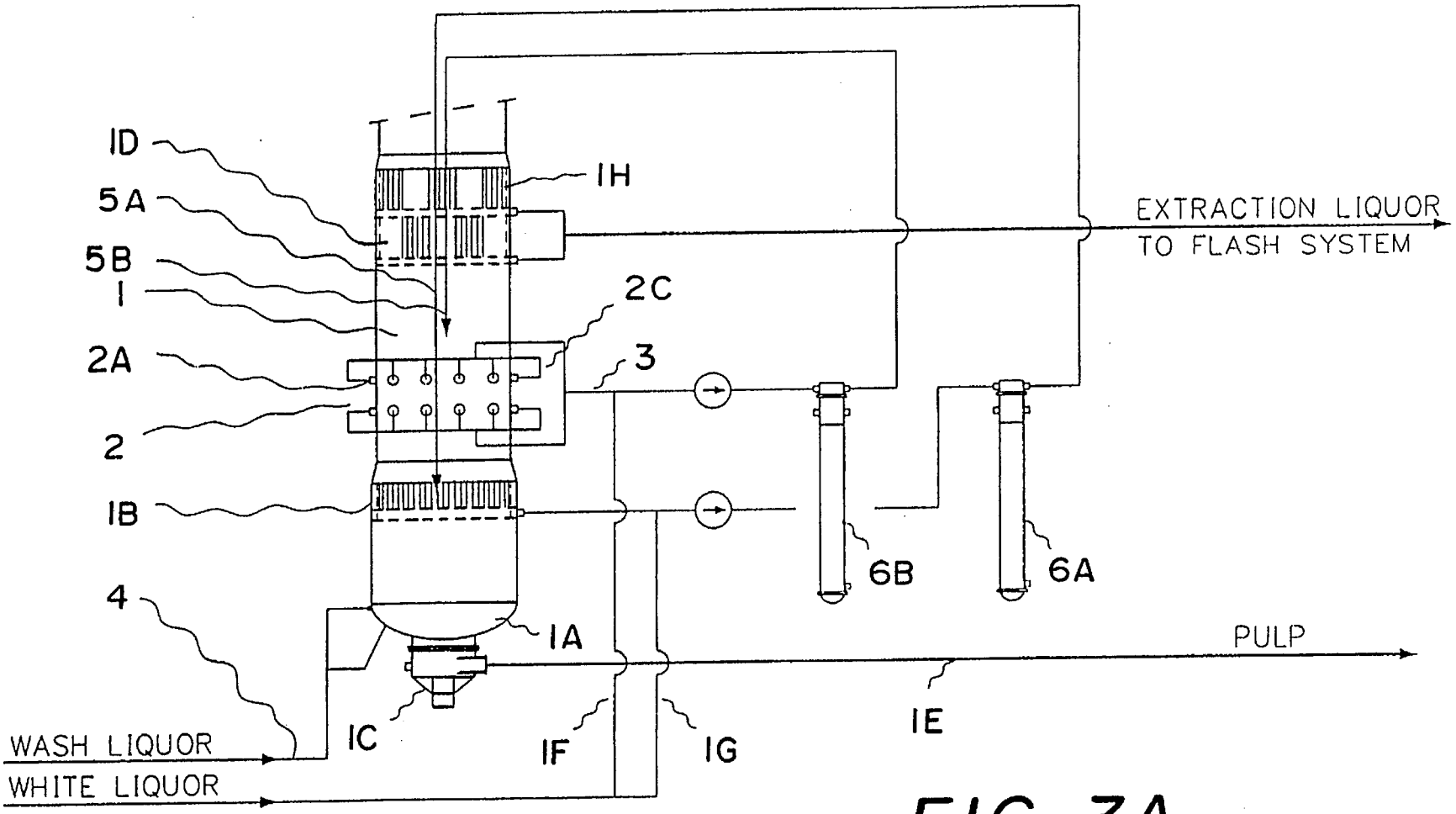
FIGS. 3A, B and C show the converstion of an existing digester to the screen system of this invention, using circular screens, to be operated according to the novel process and especially different embodiments of back flushing systems.

FIG. 3A shows the lower part of a digester 1, which is intended to represent an existing digester shell on which has been arranged a new digester screening arrangement 2 provided to raise the temperature in the counter-current zone. The digester is of the type which has an upper concurrent part and a lower counter-current part. In such a digester, full cooking temperature is normally maintained in the concurrent zone (i.e. about 162° C. for hardwood and about 168° C. for softwood) while in the counter-current part, which in the main is a washing zone, the temperature is about 135° C. on a level with the lower screen.

In the apparatus, the counter-current zone of the digester which has been fitted with a further screening arrangement will be referred to as a cooking zone, even if it is to be considered as a washing zone according to conventional operation.

The new digester screening arrangement 2 (in FIG. 3A) shows a number of circular screens 2A for withdrawal 3 of cooking liquid in the lower part of the digester and is arranged immediately above the lower screening arrangement 1B, preferably at most 1.5 metres above and more preferably at most 1 metre above, measured from the upper edge of the lower digester screening arrangement to the lower edge of the newly fitted digester screening arrangement. Wash liquor is supplied to the lower part of the digester through an inflow duct 4 attached in the vicinity of the bottom 1A of the digester and cooking liquid (with alkali addition) is provided through the central pipes 5A, 5B. The cooked pulp is taken out from the bottom of the digester via a conduit 1E.

One of these central pipes, 5A, which are conventionally provided in the original system of a digester, penetrates down to the lower screening members 1B of the digester, after which the liquid, after heating via the first heat exchanger 6A, discharges through the said pipe on a level with the latter digester screening members. Subsequently, a part of the liquid flows in a counter-current direction upwards towards the newly fitted digester screening arrangement 2. The liquid withdrawn from this system passes through the said conduit arrangement 3 and is heated via a heat exchanger 6B to the desired temperature before it discharges, via a second, newly fitted central pipe 5B, immediately above the newly fitted digester screening arrangement 2. A part of the cooking liquid supplied in this manner, which liquid has thus reached the desired temperature (e.g. 158° C.), chemical strength and distribution over the whole of the cross-section of the digester, continues to flow upwardly in the digester toward the originally installed screen arrangement 1D. In a central digester screening arrangement 1D, the spent cooking liquid, together with undissolved wood material, is drawn off for further treatment. Above the screen arrangement 1D, there may be provided a level control device such as strainer 1H of conventional construction.

The surface of each screening element 2A is made relatively small, preferably less than 0.3 $m^2$, e.g. if a square screen is used a measure of about 500 mm×500 mm is preferred. An advantage of screening elements of small area is that efficient back flushing can be achieved, which is often of great importance if the circulation flow is to function efficiently. The new screening arrangement 2 is preferably fitted with ring pipes 2C from which an individual conduit goes to each and every one of the screening elements 2A. Using such a construction, and a valve arrangement belonging to it, a limited number (for example 4) of screening units 2A can be efficiently back-flushed at a time. Owing to the relatively small total screening surface which is back-flushed under these circumstances (for example 0,5–1 $m^2$), a very efficient back-flushing which cleans the screens is obtained, thereby ensuring that the circulation is highly efficient.

Figure 3B:
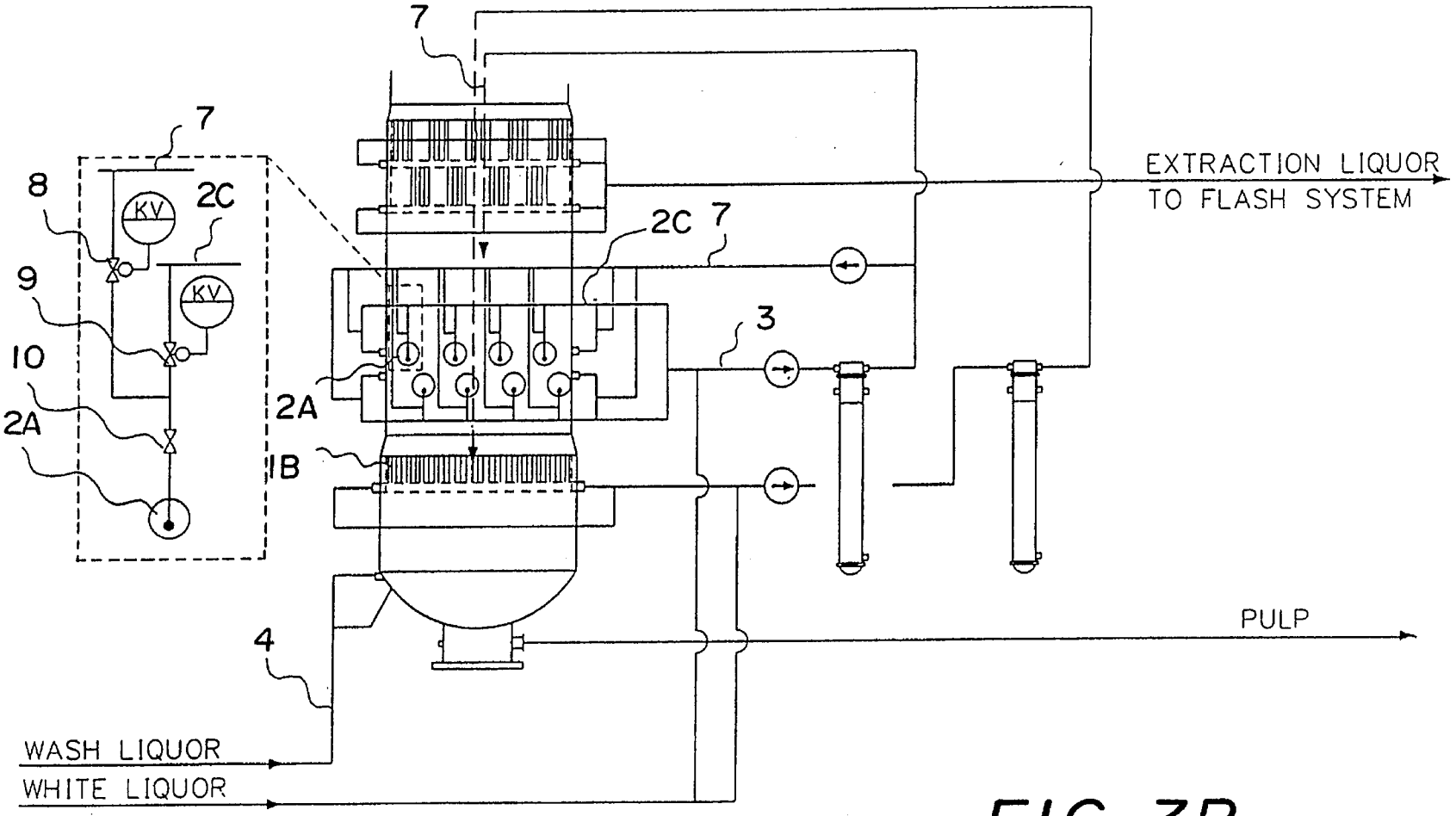

In FIG. 3B, there is shown embodiment of how such a back flushing system can be arranged. By way of example, the back flushing system is shown in connection with circular screens, but could of course also be used for angular screens, e.g. rectangular screens. The back flushing liquid is collected via a branch conduit 7 (the main conduit for back flushing) from the liquid which circulates from the screens 2A via conduit 3 and is passed out through central pipe 5B. The liquid which is fed into the main back flushing conduit 7 is thereafter sequentially fed to the different screens 2A by means of a number of valves 8, 9 (see enlarged part of FIG. 3B). Each of the valves of the digester will may electrically and remote controlled by the use of motors or solenoids 15. Beside the two valves needed for each screen 2A for providing the back flushing there is also provided a main valve 10 which provides for the possibility of shutting off completely the liquid supply from and to a screen. The liquid is withdrawn from the screen element 2A via a ring pipe 2C (and further via main pipe 3) and accordingly the main valve 10 and withdrawal valve 9 would then be opened whereas the back flushing valve 8 would then be closed.

During back flushing the main valve 10 is opened, the withdrawal valve 9 is closed and the back flushing valve 8 opened. Preferably this is performed in a sequential manner so that four screens are back flushed at the same time meanwhile the remaining screens, e.g. 20, would withdraw liquid. Hence preferably the pressure in the main conduit for back flushing 7 would be substantially equal.

Figure 3C:
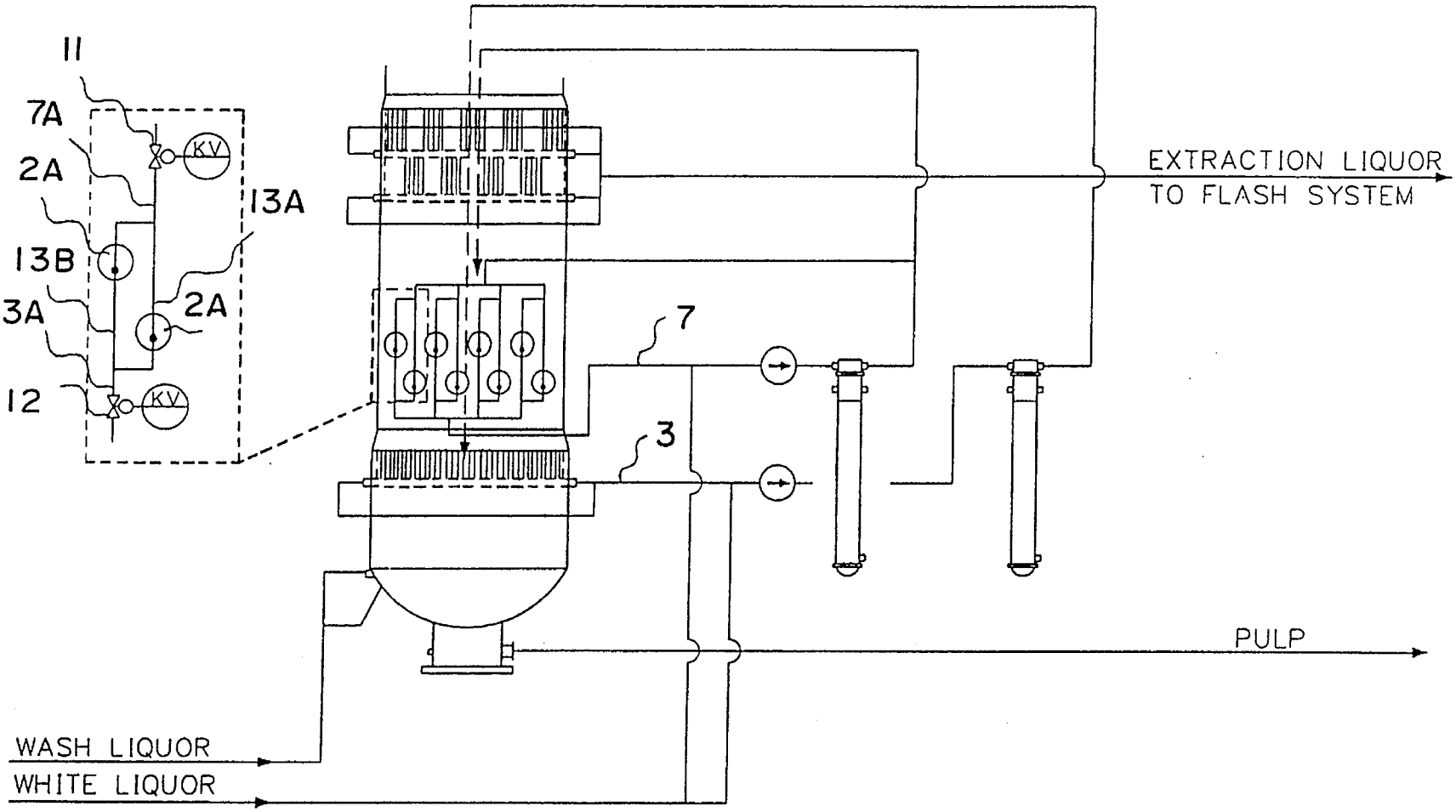

In FIG. 3C it is shown a preferred embodiment of how to arrange a back flushing system (which can also be used for angular screens). Also here there is provided a main conduit 3 for withdrawal of a liquid and main pipe 7 for the supply of back flushing liquid. Two screen elements 2A are interconnected with each other via a conduit forming a loop. This loop has an upper part 13A interconnected with the back flushing conduit 7 via branch conduit 7A. A valve 11 is used in this branch conduit 7A. The lower part of the loop 13B is interconnected with a branch conduit 3A which is joined with the withdrawal conduit 3. A valve 12 is fitted in the withdrawal branch conduit 3A. During withdrawal, the valve 11 in the upper branch conduit 7A would be closed whereas the withdrawal valve 12 would be opened. Liquid will then be withdrawn from both of the screens 2A via the lower part of the loop 13B and the branch conduit 3A and further into the withdrawal conduit 3. During back flushing, which is performed sequentially, the upper valve 11 will open and the lower valve 12 will close and the back flushing liquid will then be introduced via branch pipe 7A through the upper part of the loop 13A into both of the screens 2A in order to rinse the screen faces. The advantage with the latter described embodiment is that the number of valves required is reduced, in relation to a conventional arrangement.

Figure 4:
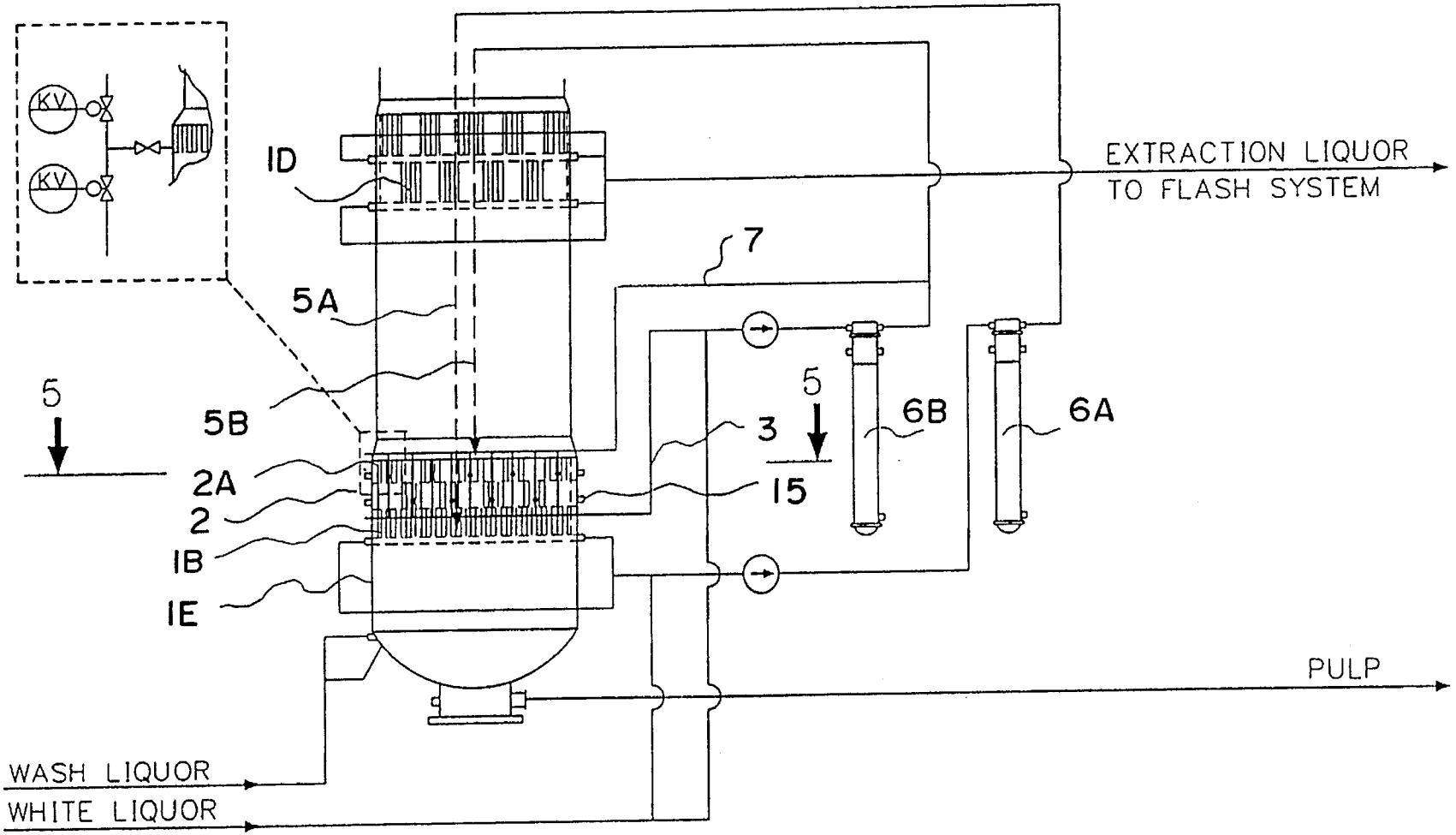
FIG. 4 shows the lower part of a digester seen from the side, which digester has a lowermost screen arrangement of a conventional kind having a header and above which lower screen arrangement there is arranged a preferred kind of angular screen arrangement.

In FIG. 4 there is shown the lower part of a digester which has been designed in order to provide for highly efficient liquid distribution in the lower part. The operation of the digester is the same as for the one shown in FIG. 3A. A major difference, however, is that the digester shown in FIG. 4 has two screen arrangements 1B, 2 positioned within the lowermost cylindrical portion 1E (the so-called lowest step-out) of the digester. As can be seen from FIG. 4 (see also FIG. 8) the second screen arrangement 2 comprises a number of rectangular (preferably square) screen elements 2A which are positioned in a staggered manner adjacent above the lowest screen arrangement 1B. The lowest screen arrangement 1B (as has already been mentioned) is of the conventional kind comprising a circular row of a number of screens each being in communication with a header or chamber through which the liquid is withdrawn from the screens into the circulation flow via heat exchanger or other heating means 6A and further into the central pipe 5A. Furthermore it is shown in FIG. 4 that each screen element 2A is provided with an individual inlet and outlet pipe 15, in order to withdraw liquid and back flush liquid respectively.

For performing the back flushing any of the two methods described in connection with the FIGS. 3B and 3C could be used but the method according to 3C is more preferred. Further in this connection it should be noted that the efficiency of the back flushing of each screen is inversely proportional to the number of screens being back flushed at the time, since the flow is substantially constant, i.e. it is more effective to direct all the flow to two screens than to four. For example, four screens can be shut off from withdrawal at the same time but only two of them being back flushed at the time. If for instance each set of four screens is shut off from withdrawal for a period of 20 seconds only two of them are back flushed during the first 10 seconds and accordingly the remaining pair during the last 10 seconds. Using such a system each screen will be back flushed every four minutes during 10 seconds. Even more effective would be to back flush one screen at the time, e.g. for 5 seconds.

Figure 5:
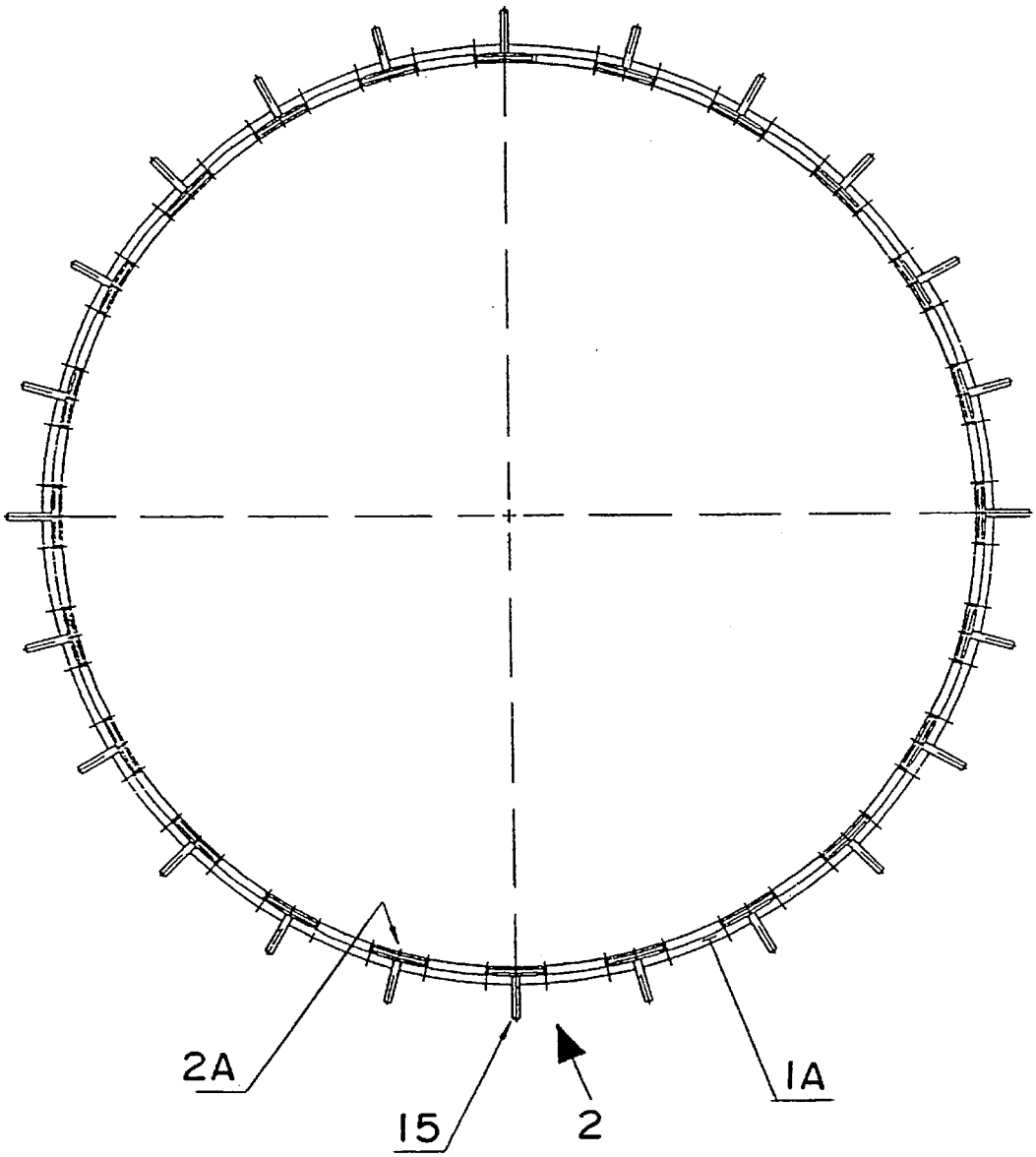
FIG. 5 shows a cross sectional view of the digester along a horizontal line.

In FIG. 5 there is shown a cross sectional view along a horizontal line of the digester arrangement shown in FIG. 4. From this figure, it is made clear that the screens 3A lie flush with the interior wall 1A and do not penetrate the wall 1A of the digester 1 but only a pipe 15 for withdrawal and supply of liquid extends outwardly of the perimeter wall 1A of the digester.

Figure 6:
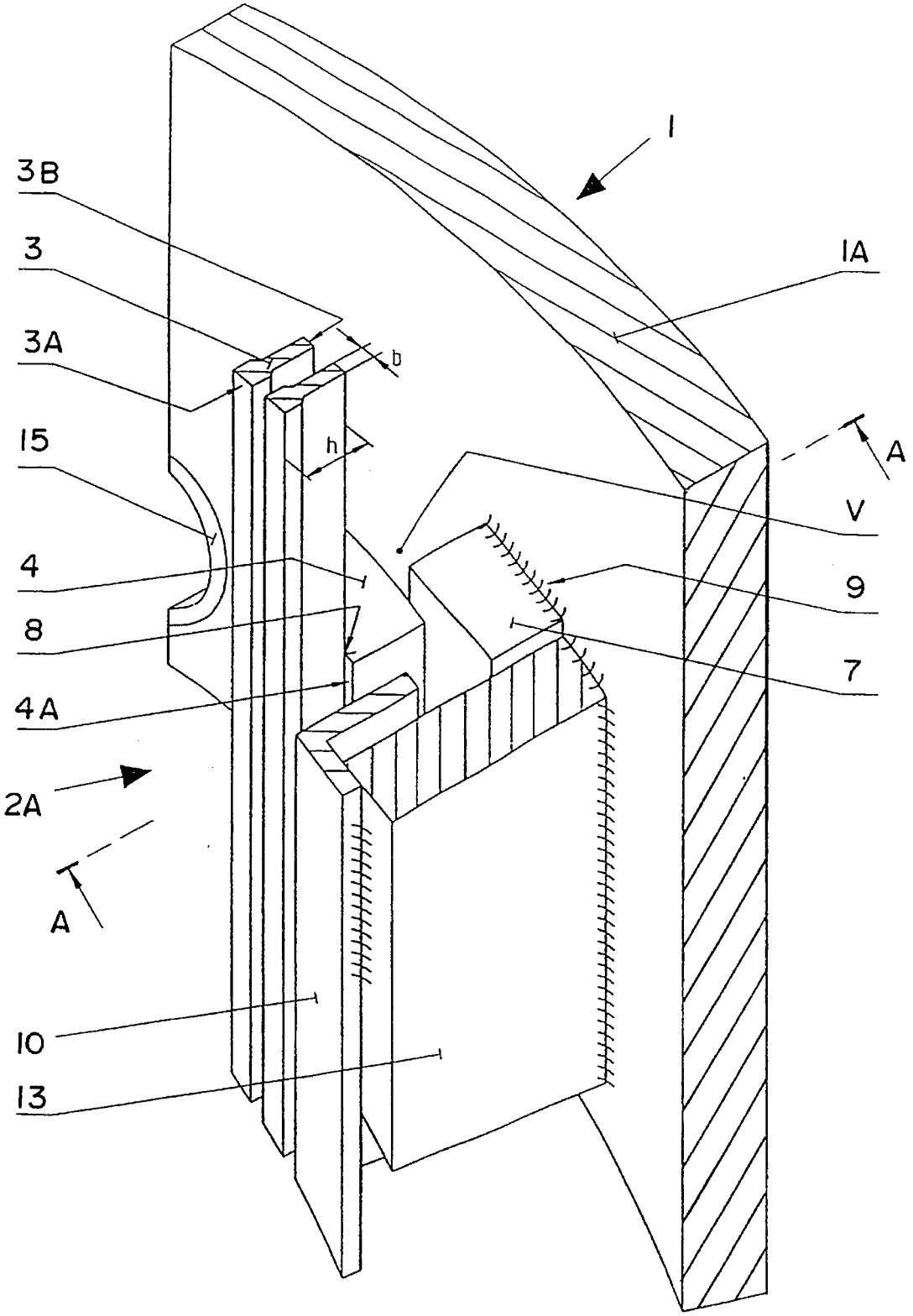
FIG. 6 shows a cross sectional perspective view of a preferred embodiment of a rectangular screen according to the invention.

FIG. 6 shows a perspective view of a screen according to another embodiment of the invention where each screen element 2A is welded onto the inner surface of the digester vessel 1. It is important that the screen is welded to the digester wall 1A in such a manner that a sealing function is obtained in order to be able to back flush the screens 2A efficiently.

In this embodiment, there is shown two rods 3, a plurality of which form the screen face 3A and will extend parallel to eachother across a selected dimension to cover the pipe 15. The rods are welded onto vertical bars 4. The rods 3 preferably have a thickness (H) which substantially exceeds the width (B). The gaps between the rods would normally be between 3–5 mm. The bar 4 is preferably made of a material of extraordinary strength, so that the rods 3 could be supported without any other supporting members. A shoulder 7 supports each bar 4 at each respective end. The shoulders 7 are also welded as at 9 onto the interior of the digester shell 1A.

Figure 7:
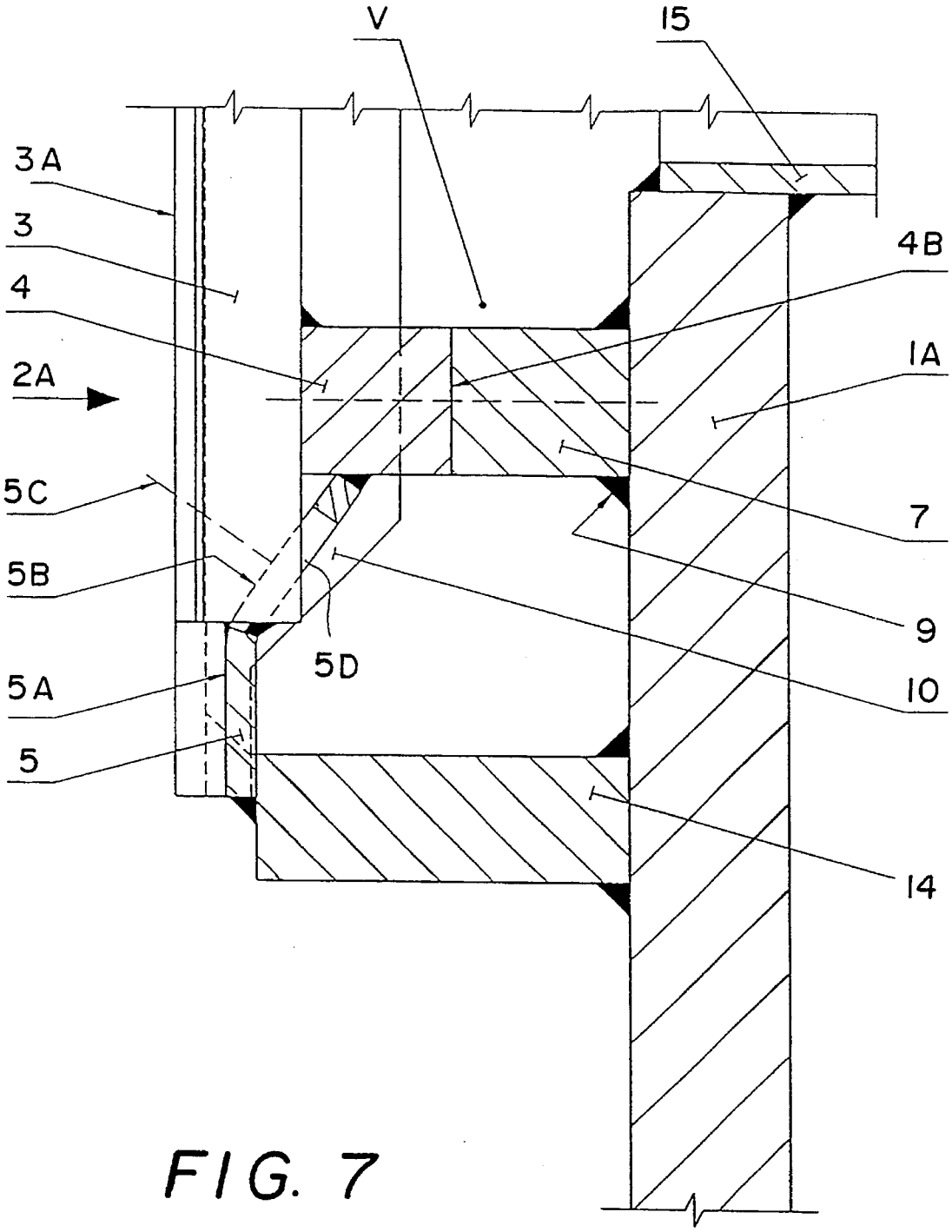
FIG. 7 shows the lowermost part of a preferred screen seen in a cross sectional view taken along a vertical line.

As has already been mentioned each screen has to be fitted in such a manner that a volume is created behind the screen back 3B and between the digester shell 1A which is substantially sealed, i.e. can only communicate via the gaps between the rods 3 and the outlet and inlet pipe 15. In order to provide for this seal arrangement the screen is arranged with L-shaped bars 10 along its periphery. (See also FIG. 7). At the vertical edges of this periphery, these L-shaped bars 10 are positioned on vertically extending supports 13, which support is welded onto the digester shell 1A and which support 13 has a height which substantially exceeds the total height of the rods 3 and bars 4. The height is selected in such a manner that the bar 4 rests on the shoulder 7 when the inner side of the L-shaped bar 10 rests on a inwardly facing surface of the support 13. Also along the horizontal periphery of the screen 2 the same principle is used as shown in FIG. 7, i.e. a horizontally arranged support 14 is welded to the interior of the digester shell 1A, which support is joined with a flat bar 5 of the screen 2 which extends substantially horizontally.

Figure 8:
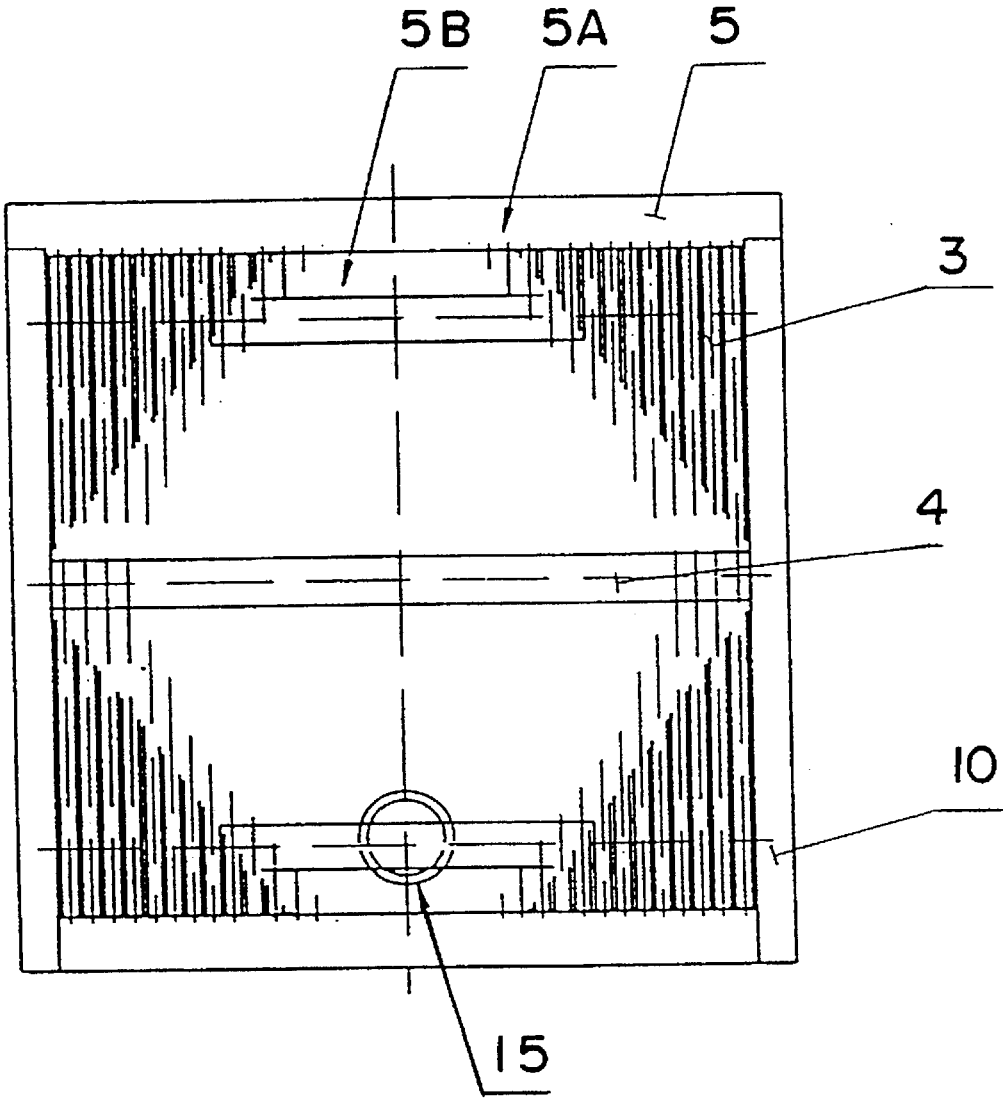
FIG. 8 is a front view of a preferred screen.
Figure 9:
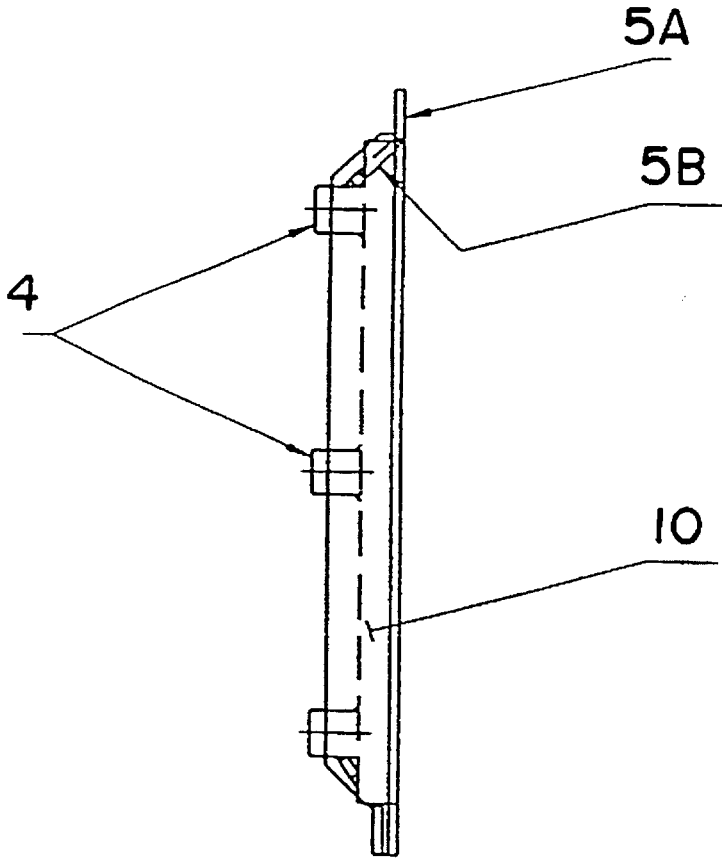
FIG. 9 is a view seen from the side of said screen.

In FIGS. 8 and 9, there is shown the in- and outlet pipe 15 positioned in the lower part of the screen in order to provide for effective withdrawal of the liquid. The horizontal flat bar 5 of the screen 2 is designed in a manner to avoid hanging of the pulp. Therefore it is arranged distanced from the screen face and has angled members 5B supporting it which are advantageous for this purpose. Moreover, the members 5B are provided with slots 5D in order to receive the outwardly projecting corners of the bars 3. When the screen needs to be disassembled, the welds fixing the flat bars 5, 10 on the supports 13, 14 are taken away (e.g. by means of grinding). Thereafter a new screen can be attached to the support members 13, 14 in a corresponding manner as has been described above. The vertical sdupport 13 has such a width that two screens can be supported by it, in such a manner that a gap is created between the two adjacent L-shaped bars 10, in order to provide for space for welding and grinding respectively.

The invention is not limited by that which has been described above, but can be varied within the scope of the subsequent patent claims. Thus, it is evident for the skilled man that any kind of digester can be fitted with the above described kind of screen, and that this kind of screen can be fitted at any level within a digester. Accordingly, e.g. a digester of the so-called MCC-type or the hydraulic type, may also advantageously be fitted with a digester screening arrangement according to the invention for cooking, so-called, isothermally, or non-isothermally. Additionally the preferred method may be used in connection with all types of cooking liquids, even if the method is principally intended for producing sulphate pulp. In addition, it is obvious to the person skilled in the art that the invention is not limited to the above mentioned exemplifying temperature levels. In this connection, however, it is important that the average temperature level in the digester preferably exceeds +150° C. but is lower than +165° C., and preferably is between +150°–155° C. for hardwood and between +160°–165° C. for softwood, and furthermore that the average temperature in the cooking zone/zones is preferably about +151° C. ±1° C., when the wood is hardwood, and that the average temperature in a digester is +159° C. ±1° C., when the wood is softwood. In addition, it is understood that screens deviating from a purely square form, for example rectangular screens, may also be used. Further it is stressed that both old and new digesters can be fitted with screens according to the invention. Further it should be noted that the basic design concept could also be used together with other screen faces than the rod-type, e.g. slotted screen faces. In an extreme embodiment it would be possible to use other kind of attachment methods than welding, e.g. glue, screw fasteners together with sealing means, etc., in order to provide for the sealed volume behind each screen face. Even if it is preferred to use one pipe 15 for each screen 2A it is of course possible to connect two or more screens to one and the same pipe.

What is claimed is:

1. A method of digesting cellulosic material comprising the steps of using a digester having a vessel having an interior surrounded by a wall where input of fiber material and cooking liquid takes place at the top of the digester in an upper concurrent cooking zone, withdrawal of spent cooking liquor is carried out from at least one digester screening system located between the top and the bottom of the digester in a counter current cooking zone, and fiber material is fed out from the bottom of the digester, and said at least one screening system being provided in the lower half of the digester, said at least one screening system has a plurality of screen members each having a non-circular screen face of which the total area is less than 1 $m^2$ and which are attached to the digester wall with seal means to form a sealed volume from which liquid only can be supplied and withdrawn through said screen face from said digester interior, said screening system including conduit means for providing an inlet and outlet for liquid, said conduit means penetrating the digester wall and communicating with said sealed volume and including the step of using at least two rows of said screening members with each of said rows extending about the interior wall of said digester and arranging said screening members in one of said rows in staggered relation to the screen members in the other of said rows and maintaining temperatures in the cooking zones so that the temperatures differ by at most +4° C. by using said screening members to control the temperature of the liquid in said counter current cooking zone of said digester.

2. The method as claimed in claim 1 wherein the step of maintaining the temperatures in the cooking zones is done so that the temperatures differ by at most +2° C.

3. The method as claimed in claim 1 wherein the step of maintaining the temperatures in the cooking zones is done so that the temperatures differ by at most +1° C.

* * * * *